US006308745B1

(12) United States Patent
Angarola et al.

(10) Patent No.: US 6,308,745 B1
(45) Date of Patent: Oct. 30, 2001

(54) MANUALLY-OPERATED SEALING TOOL FOR JOINING END PORTIONS OF PLASTIC STRAPPING, SEAL MEMBER, AND SEALED JOINT FORMED THEREBY

(75) Inventors: Barry R. Angarola, Schaumburg; Janusz Figiel, Mt. Prospect; Mathew Breckheimer, Lincolnshire, all of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/598,599

(22) Filed: Jun. 21, 2000

(51) Int. Cl.[7] ..... B21F 15/06
(52) U.S. Cl. ..... 140/154; 140/93.4
(58) Field of Search ..... 140/93.4, 150, 140/152, 153, 154

(56) References Cited

U.S. PATENT DOCUMENTS

| | | | | |
|---|---|---|---|---|
| 2,177,536 | * | 10/1939 | Porter | 140/153 |
| 2,432,306 | * | 12/1947 | Gerrard et al. | 140/154 |
| 2,680,979 | | 6/1954 | Childress . | |
| 3,089,366 | | 5/1963 | Haraden . | |
| 3,166,960 | * | 1/1965 | Roessler | 140/154 |
| 3,237,256 | | 3/1966 | Young . | |
| 3,333,607 | | 8/1967 | Haraden . | |
| 3,636,592 | | 1/1972 | Beach . | |
| 4,253,227 | * | 3/1981 | Bullington | 140/154 |
| 5,078,185 | | 1/1992 | Angarola . | |
| 5,109,575 | | 5/1992 | Angarola et al. . | |

* cited by examiner

*Primary Examiner*—Lowell A. Larson
(74) *Attorney, Agent, or Firm*—Schwartz & Weinrieb

(57) ABSTRACT

A manually-operable crimping tool for lockingly securing a seal member upon overlapped end portions of plastic strapping is provided with particular structure such that the resulting crimped seal member and overlapped end portions of the plastic strapping have an undulated configuration whereby the overlapped end portions of the plastic strapping cannot readily become loosened or disengaged with respect to each other under the influence of axially applied tensile forces. The present invention is also directed toward the particularly structured or configured seal member as well as toward the resulting sealed joint formed or defined between the seal member and the overlapped end portions of the plastic strapping.

16 Claims, 4 Drawing Sheets

MANUALLY-OPERATED SEALING TOOL FOR JOINING END PORTIONS OF PLASTIC STRAPPING, SEAL MEMBER, AND SEALED JOINT FORMED THEREBY

FIELD OF THE INVENTION

The present invention relates generally to manually-operated sealing tools, and more particularly to a manually-operated sealing tool for joining the overlapped ends of plastic strapping, as well as to the seal member and the sealed joint formed upon the overlapped ends of the strapping by means of such tool effectively crimping the preformed seal member onto the overlapped ends of the plastic strapping.

BACKGROUND OF THE INVENTION

Manually-operated sealing tools for joining and sealing the overlapped ends of steel or plastic strapping are of course well-known and the state of the prior art is exemplified by means of U.S. Pat. No. 5,078,185 which was issued on Jan. 7, 1992 to Angarola, U.S. Pat. No. 3,333,607 which was issued on Aug. 1, 1967 to Haraden, U.S. Pat. No. 3,089,366 which was previously issued on May 14, 1963 to Haraden, and U.S. Pat. No. 2,680,979 which was issued on Jun. 15, 1954 to Childress. In addition, it is seen that U.S. Pat. No. 5,109,575 which was issued on May 5, 1992 to Angarola et al., U.S. Pat. No. 3,636,592 which was issued on Jan. 25, 1972 to Beach, and U.S. Pat. No. 3,237,256 which was issued on Mar. 1, 1966 to Young are also of interest for their disclosures of various sealed joints which are impressed or formed upon overlapped end portions of steel or plastic strapping.

While the aforenoted tools, particularly, for example, the tool such as that disclosed and illustrated within the patent issued to Childress, certainly operate satisfactorily in that they adequately perform clinching or crimping operations in connection with the mounting of seal members upon overlapped ends of strapping, the tools are relatively complex. In addition, and more importantly, while such tools can of course readily achieve their sealing functions, the resulting crimped seals, comprising the seal members and the overlapped ends of the strapping, are relatively flat or planar. Accordingly, the seals are relatively insecure in that the seals are subject to disengagement, that is, the overlapped ends of the strapping can become loosened with respect to each other, under the exertion of tensile loads because the flat or planar surfaces of the strapping ends can in effect slide or move with respect to each other.

A need therefore exists in the art for a new and improved manually-operated sealing tool for sealing the overlapped ends of plastic strapping, as well as for a seal member to be used in conjunction with such tool, by means of a sealed joint which will effectively prevent the loosening or relative disengagement of the overlapped ends of the plastic strapping with respect to each other.

OBJECTS OF THE INVENTION

Accordingly, it is an object of the present invention to provide a new and improved manually-operated sealing tool, seal member, and sealed joint, for sealing together the overlapped ends of plastic strapping.

Another object of the present invention is to provide a new and improved manually-operated sealing tool, seal member, and sealed joint, for sealing together the overlapped ends of plastic strapping wherein such tool, seal member, and sealed joint effectively overcome the various drawbacks and operational disadvantages characteristic of the PRIOR ART.

An additional object of the present invention is to provide a new and improved manually-operated sealing tool, seal member, and sealed joint, for sealing together the overlapped ends of plastic strapping wherein such tool is relatively simple in construction.

A further object of the present invention is to provide a new and improved manually-operated sealing tool, seal member, and sealed joint, for sealing together the overlapped ends of plastic strapping wherein such tool can effectively crimp the seal member upon the overlapped ends of the strapping such that the resulting sealed joint has a substantially undulated configuration whereby such sealed joint, comprising the crimped seal member and the overlapped ends of the strapping, effectively comprises a locked structure such that the overlapped ends of the strapping cannot become loosened or disengaged with respect to each other.

SUMMARY OF THE INVENTION

The foregoing and other objectives are achieved in accordance with the teachings and principles of the present invention through the provision of a new and improved manually-operated sealing tool, seal member, and sealed joint, for sealing together the overlapped ends of plastic strapping wherein such tool can effectively crimp the seal member upon the overlapped ends of the strapping such that the resulting sealed joint has a substantially undulated configuration. In this manner, the sealed joint, comprising the crimped seal member and the overlapped ends of the plastic strapping, effectively comprises a locked structure such that the overlapped ends of the plastic strapping cannot become loosened or disengaged with respect to each other. The tool comprises a pair of manually-operated handles, an anvil, a pair of jaws operatively connected to the manually-operated handles, and a pair of side plates. The inner surfaces of the jaws comprise convex and concave portions, and the anvil member comprises in effect a central convex portion and a pair of recessed side portions. The side plates and anvil portions therefore define relative convex and concave portions which cooperate with the concave and convex portions of the inner surfaces of the jaws when the jaws are moved to their crimping positions. Consequently, the resulting locked structure, comprising the crimped seal member and the overlapped end portions of the plastic strapping, has an undulated configuration whereby loosening or disengagement of the overlapped ends of the plastic strapping is effectively prevented.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
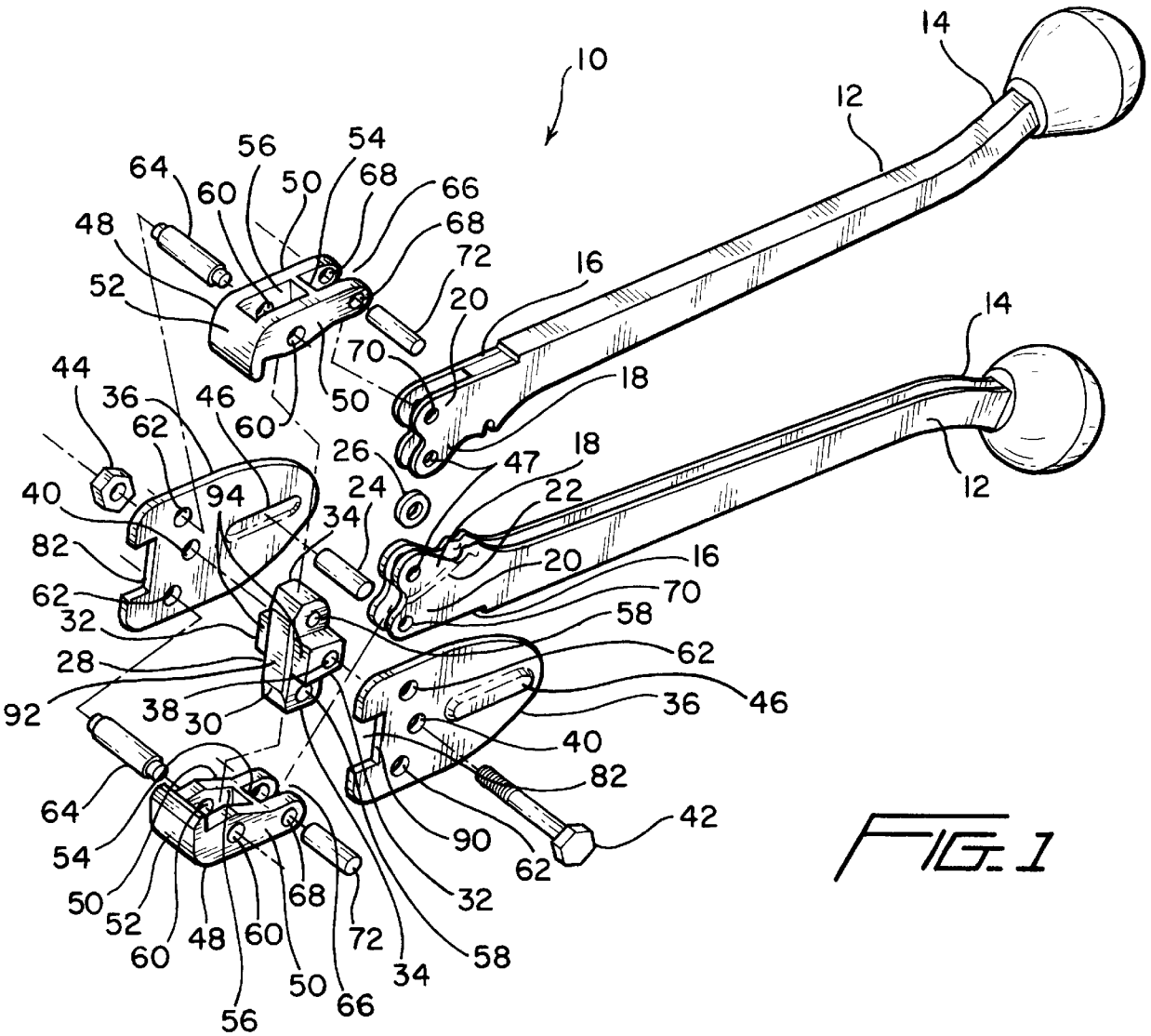
FIG. 1 is an exploded perspective view of a new and improved manually-operable sealing tool for sealing together the overlapped ends of plastic strapping.
Figure 2:
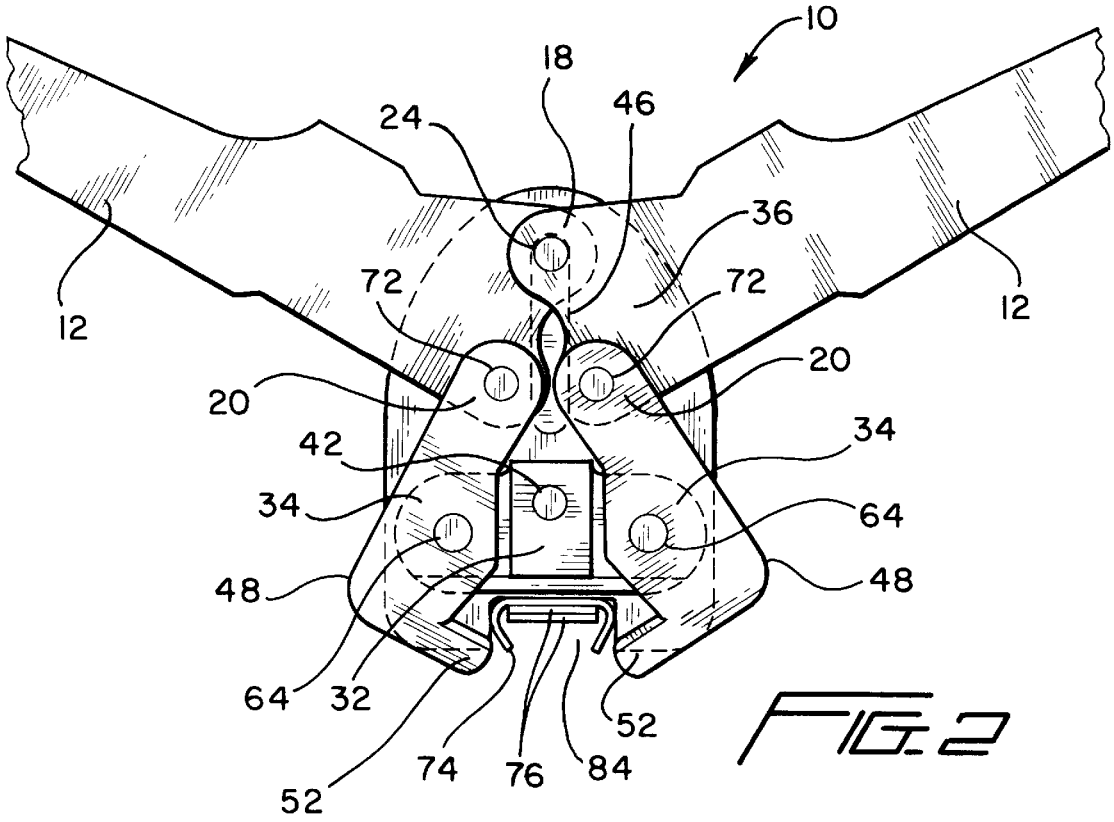
FIG. 2 is a side elevational view of the new and improved manually-operated sealing tool for sealing together the overlapped ends of plastic strapping as shown in FIG. 1 wherein the handles and jaws are disposed in their opened positions.
Figure 10:
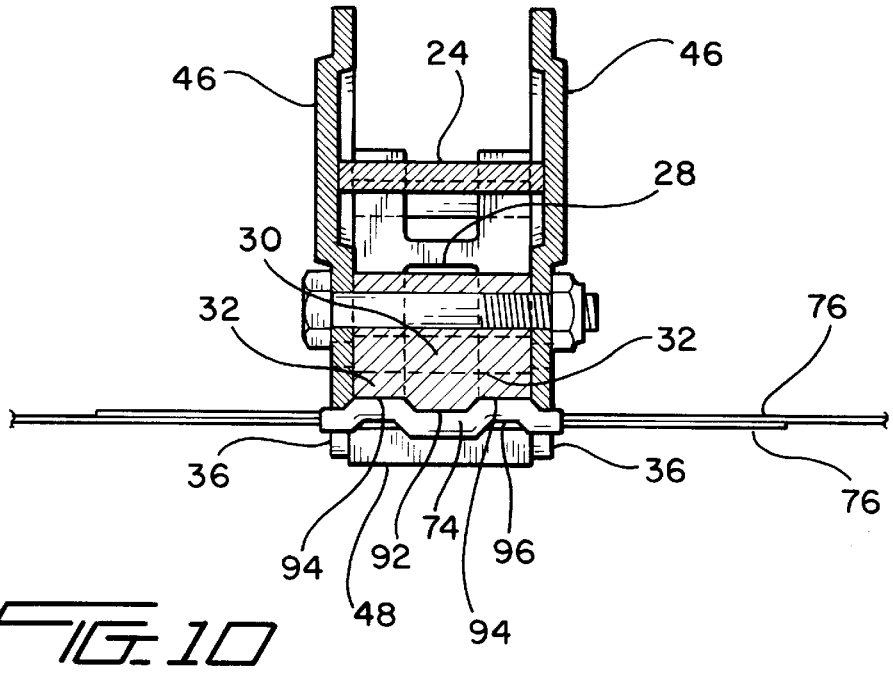
FIG. 10 is a partial cross-sectional view, similar to those of FIGS. 6A,7A, and 8, showing in more detail the side plates, anvil, and jaw components of the manually-operated tool when the components are disposed at their relative positions with respect to each other and with respect to the overlapped ends of the plastic strapping during the final stage of the crimping operation such that the seal member and the overlapped ends of the plastic strapping are formed with the undulated configuration.
Figure 3:
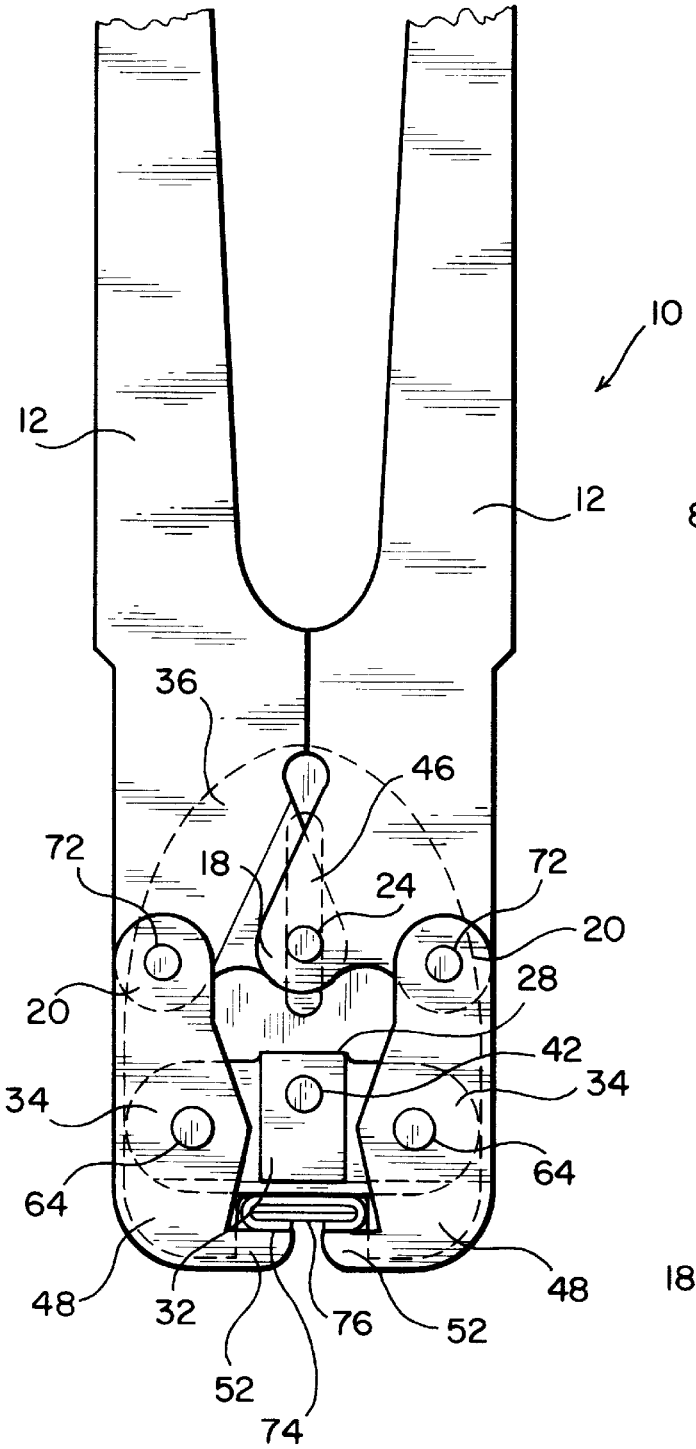
FIG. 3 is a side elevational view of the new and improved manually-operated sealing tool for sealing together the overlapped ends of plastic strapping as shown in FIG. 2 showing, however, the handles and jaws disposed in their closed positions.

Referring now to the drawings, and more particularly to FIGS. 1–3 thereof, a new and improved manually operable sealing tool, for lockingly sealing together overlapped ends of plastic strapping and constructed in accordance with the principles and teachings of the present invention, is disclosed and is generally indicated by the reference character 10. The sealing tool 10 is seen to comprise a pair of identical handles 12,12 each of which respectively has a manipulative distal end portion 14,14 and an actuated proximal end portion 16,16. More particularly, each one of the proximal end portions 16,16 comprises a laterally inward clevis axle portion 18 and a laterally outward pivot portion 20. It is noted that one of the members comprising each one of the clevis axle portions 18 is laterally offset with respect to the other one of the members comprising each one of the clevis axle portions 18 as at 22, and this structure permits the two clevis axle portions 18,18 to be enmeshed or interdigitated with respect to each other when the clevis axle portions 18,18 are assembled with respect to each other upon a toggle pin 24 which is adapted to pass through the clevis axle portions 18,18 as well as an axially central washer 26.

An anvil member 28 is provided with a central section 30 and a pair of side portions 32,32 wherein the side portions 32,32 are integral with the central section 30 and extend axially outwardly from the central section 30. The anvil member 28 further comprises a pair of transversely disposed end portions 34,34 which are also integral with, and in effect comprise extended portions of, the central section 30, and a pair of side plates 36,36 are adapted to be fixedly mounted upon the side portions 32,32. More particularly, the anvil member 28 is provided with an axially extending throughbore 38 which passes axially through the side portions 32,32 as well as the central section 30, and each one of the side plates 36,36 is respectively correspondingly provided with an aperture 40,40. A threaded bolt fastener 42 is adapted to be passed through the apertures 40,40 defined within the side plates 36,36 as well as the throughbore 38 of the anvil member 28, and a nut member 44 is adapted to be threadedly disposed upon the threaded end portion of the bolt fastener 42 such that the side plates 36,36 are fixedly mounted upon the oppositely disposed side portions 32,32 of the anvil member 28. It is further noted that each one of the side plates 36,36 includes an axially outwardly upset slotted or track portion 46,46 for housing or accommodating the opposite distal ends of the toggle pin 24 whereby, as will be more fully appreciated hereinafter, after the toggle pin 24 has been passed through apertures 47,47 defined within each one of the clevis axle portions 18,18 respectively defined upon the handles 12,12, the opposite distal ends of the toggle pin 24 can reciprocatingly move or ride within the slots or tracks 46,46 as the tool handles 12,12 are manipulated during relative opening and closing movements thereof in connection with a sealing and crimping operative cycle to be performed upon a seal member to be applied to the overlapped end portions of the plastic strapping.

With reference continuing to be made to FIGS. 1–3, the sealing tool 10 is seen to further comprise a pair of pivotal jaws 48,48 wherein the pivotal jaws 48,48 are adapted to be pivotally mounted upon the anvil member 28 and interposed between the oppositely disposed side plates 36, 36. More particularly, each one of the pivotal jaws 48,48 comprises a pair of axially spaced side frame members 50,50 which are integrally connected together by means of a crimping jaw member 52 which is integrally connected to first end portions of the side frame members 50,50 and a cross-piece 54 which is integrally connected to intermediate portions of the side frame members 50,50. As a result of such structure, a substantially rectangularly-shaped aperture 56 is defined within each pivotal jaw 48 which is adapted to house or accommodate a respective one of the end portions 34 of the anvil member 28. The ends portions 34,34 are each respectively provided with a throughbore 58,58, and in a corresponding manner, the side frame members 50,50 of each one of the pivotal jaws 48,48 are respectively provided with apertures 60, 60. The side plates 36,36 are also respectively provided with apertures 62,62, and a jaw pin 64 is adapted to be passed through the apertures 62,62 of each side plate 36,36, the apertures 60,60 defined within each pivotal jaw 48,48, and the throughbore 58 defined within the anvil member 28, with the opposite end portions of the jaw pin 64 being snap fitted within the apertures 62,62 of the side plates 36,36, so as to pivotally mount the pivotal jaws 48,48 upon the anvil member 28 and between the side plates 36,36.

It is still further to be appreciated that the free end portions of the side frame members 50,50 of each pivotal jaw 48,48, along with each cross-piece 54, together define a clevis portion 66,66 which is adapted to respectively house or accommodate the pivot portion 20,20 of each handle 12,12. More particularly, each one of the free end portions of the side frame members 50,50 is provided with an aperture 68, while the pivot portions 20,20 of the handles 12,12 are provided with throughbores 70,70. In addition, in order to assemble such pivot portions 20,20 of the handles 12,12 within the clevis portions 66,66 of the pivotal jaws 48,48, each assembly further includes a link pin 72,72 which is passed through the clevis member apertures 68,68 and the pivot portion throughbores 70,70 so as to pivotally retain the pivotal jaws 48,48 assembled with the handles 12,12.

As can readily be appreciated from FIGS. 2 and 3, when the handles 12,12 are pivoted with respect to the toggle pin 24 so as to be disposed in their relatively opened position as shown in FIG. 2, the opposite ends of the toggle pin 24 are disposed at the upper ends of the slots, channels, or tracks 46,46 of the side plates 36,36, the pivotal jaws 48,48 are pivoted around the jaw pins 64,64 such that the clevis end portions 66,66 of the pivotal jaws 48,48 are pivoted radially inwardly so as to be disposed adjacent to each other while the jaw members 52,52 are effectively pivoted radially outwardly so as to be relatively remote from each other and thereby disposed at relatively opened positions. The manually-operable tool 10 is therefore readied for the initiation of a crimping operation whereby a seal member 74 can be lockingly sealed upon overlapped end portions 76,76 of plastic strapping. Subsequently, when the handles 12,12 are pivoted with respect to the toggle pin 24 so as to be disposed in their relatively closed position as shown in FIG. 3, the opposite ends of the toggle pin 24 are disposed at the lower ends of the slots, channels, or tracks 46,46 of the side plates 36,36, the pivotal jaws 48, 48 are pivoted around the jaw pins 64,64 such that the clevis end portions 66,66 of the pivotal jaws 48,48 are pivoted radially outwardly so as to be disposed relatively remote from each other while the jaw members 52,52 are effectively pivoted radially inwardly so as to be moved toward each other to their relatively closed position. In this manner, the jaw members 52,52 perform the crimping operation upon the seal member 74 so as to lockingly engage or seal the same upon the overlapped end portions 76,76 of the plastic strapping.

Figure 4:
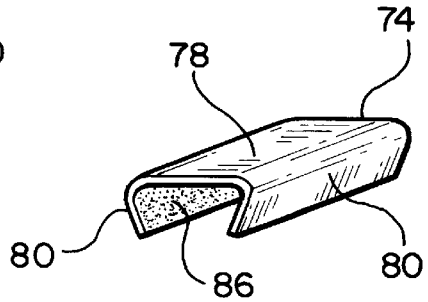
FIG. 4 is a first embodiment of a new and improved seal member to be used in connection with the new and improved manually-operated sealing tool shown in FIGS. 1–3 and to be applied to the overlapped ends of the plastic strapping so as to form a locked joint upon the overlapped ends of the plastic strapping and thereby securely seal such overlapped ends of the plastic strapping together.

In connection with the particulars comprising the crimping operation so as to lockingly secure the seal member 74 upon the overlapped end portions 76,76 of the plastic strapping, it is initially noted that a first embodiment of the seal member 74 constructed in accordance with the principles and teachings of the present invention is disclosed within FIG. 4. It is noted that the seal member 74 comprises a three-sided structure which generally has the configuration of an inverted U and is seen to be defined by means of an upper member 78 and a pair of dependent side members 80,80. In addition, unlike the conventional seal member disclosed within the aforenoted U.S. Pat. No. 3,237,256 which was issued to Young on Mar. 1, 1966, the side members 80,80 are effectively disposed in a convergent mode with respect to each other as opposed to the divergent mode as disclosed within Young. This convergent mode of the side members 80,80 enables the seal member, disposed around the overlapped ends of the plastic strapping, to be advantageously initially disposed or positioned within the manually-operable tool 10 in preparation for the crimping operation to be performed upon the seal member 74 so as to lockingly secure the seal member 74 upon the overlapped end portions 76,76 of the plastic strapping. More particularly, as may best be appreciated from FIGS. 1–3, the lower edge portion of each one of the side plates 36,36 of the tool 10 is provided with a three-sided cut-out region 82 which has a predetermined dimension wherein the cut-out regions 82,82 cooperate together so as to in effect define an axially oriented channel 84, as best seen in FIG. 2, within which the seal member 74, and the overlapped ends 76,76 of the plastic strapping, can be longitudinally disposed. As can then be best appreciated from FIGS. 2 and 3, the jaw members 52,52 can then engage the dependent sides 80,80 of the seal member 74 so as to effectively move the dependent sides 80,80 of the seal member 74 from their relatively opened position to their relatively closed position at which the seal member 74 is then crimped upon the overlapped end portions 76,76 of the plastic strapping.

Figure 5:
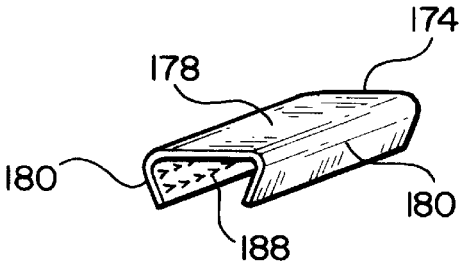
FIG. 5 is a second embodiment of a new and improved seal member to be used in connection with the new and improved manually-operated sealing tool shown in FIGS. 1–3 and to be applied to the overlapped ends of the plastic strapping so as to form a locked joint upon the overlapped ends of the plastic strapping and thereby securely seal such overlapped ends of the plastic strapping together.
Figure 6A:
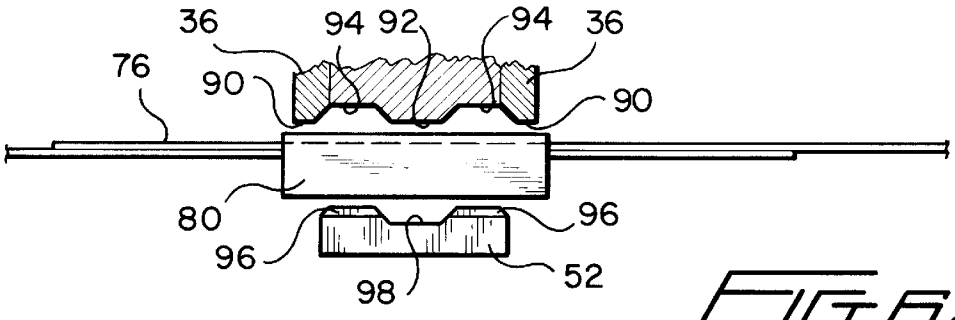
FIG. 6A is a partial cross-sectional view of the side plates, anvil, and jaw components of the manually-operated tool shown in FIGS. 1–3 when the components are disposed at their relative positions with respect to each other and with respect to the overlapped ends of the plastic strapping just prior to initiation of a crimping operation to be performed in connection with the seal member so as to apply the same to the overlapped ends of the plastic strapping.
Figure 6B:
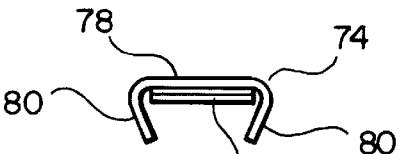
FIG. 6B is an end elevational view, corresponding to the partial, cross-sectional view of FIG. 6A, showing the seal member and overlapped ends of the plastic strapping during such initial disposition of the seal member with respect to the overlapped ends of the plastic strapping.
Figure 7A:
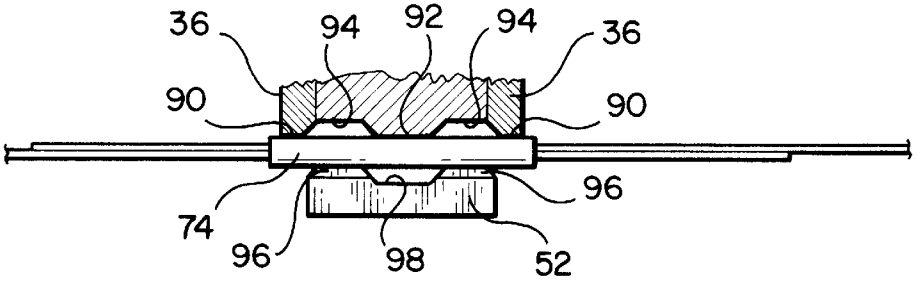
FIG. 7A is a partial cross-sectional view of the side plates, anvil, and jaw components of the manually-operated tool shown in FIGS. 1–3, and similar to that of FIG. 6A illustrating, however, the components disposed at their relative positions with respect to each other and with respect to the overlapped ends of the plastic strapping during the initial folded disposition of the side portions of the seal member during the crimping operation being performed in connection with the seal member so as to apply the same to the overlapped ends of the plastic strapping.
Figure 7B:
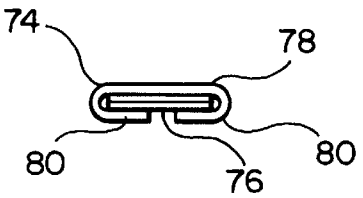
FIG. 7B is an end elevational view, corresponding to the partial, cross-sectional view of FIG. 7A, showing the seal member and overlapped ends of the plastic strapping during the initial folded disposition of the side portions of the seal member with respect to the overlapped ends of the plastic strapping.

As can also be seen from FIG. 4, and in order to increase or enhance in effect the gripping force generated between the seal member 74 and the outer surfaces of the overlapped end portions 76,76 of the plastic strapping when the seal member 74 is crimpingly locked upon the end portions 76,76 of the plastic strapping, the interior surfaces of the seal member 74 may be provided with a grit material 86 similar to that disclosed within the aforenoted patent issued to Young. However, as disclosed within FIG. 5, a second embodiment of the seal member is disclosed and is denoted by the reference character 174 wherein in lieu of the grit material 86, the interior surfaces of the seal member 174 may be provided with teeth members 188 which are similar to the teeth disclosed within U.S. Pat. No. 5,109,575 which was issued to Angarola et al. on May 5, 1992.

With reference lastly being made to FIGS. 6A–9 and 10, the formation of the sealed or crimped joint upon the overlapped end portions 76,76 of the plastic strapping, and the unique, new and improved structure of the tool 10 constructed in accordance with the principles and teachings of the present invention for forming such sealed or crimped joint, is disclosed. More particularly, it is seen that each cut-out region 82,82 of each side plate 36,36 comprises undersurface or bottom surface portions 90,90, the central section 30 of the anvil 28 comprises a first bottom or undersurface portion 92, and each one of the side portions 32, 32 of the anvil 28 comprises a second bottom or undersurface portion 94,94.

Figure 8:
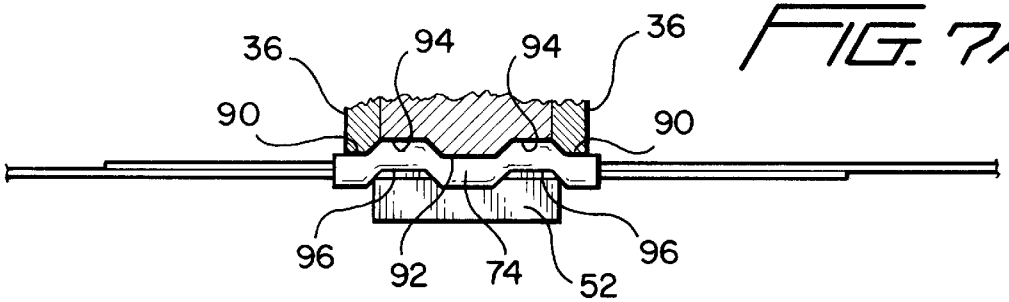
FIG. 8 is a partial cross-sectional view of the side plates, anvil, and jaw components of the manually-operated tool shown in FIGS. 1–3, and similar to that of FIGS. 6A and 7A illustrating, however, the components disposed at their relative positions with respect to each other and with respect to the overlapped ends of the plastic strapping during the final stage of the crimping operation whereby the seal member and the overlapped end portions of the plastic strapping now have the undulated configuration such that the seal member and the overlapped ends of the plastic strapping are securely locked together.
Figure 9:
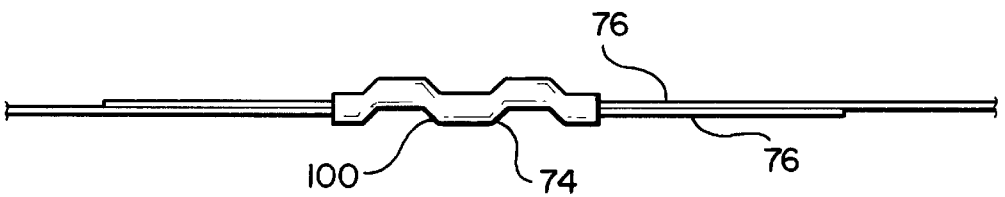
FIG. 9 is a side elevational view of the seal member and the overlapped end portions of the plastic strapping showing such components in their final crimped mode and having the undulated configuration such that the seal member and the overlapped ends of the plastic strapping are securely locked together.

In addition, as can best be appreciated from FIGS. 6A, 7A, 8, and 10, the second undersurface portions 94, 94 of the side portions 32,32 of the anvil 28 are in effect disposed at an elevational level which is raised, offset, or recessed with respect to, or above, the elevational level of the undersurface portions 90,90 of the side plates 36,36 and the first undersurface portion 92 of the central section 30 of the anvil 28. In this manner, the undersurface region across the tool as considered in the axial direction has in effect an undulated configuration. In particular, it is seen in effect that the undersurface portions 90,92, and 94 define alternative sections having substantially trapezoidal configurations. In a similar manner, it is seen that the upper inner surface of each one of the jaw members 52,52 of the pivotal jaws 48,48 is provided with a pair of axially spaced protrusions 96,96 which define third surface portions which are in effect axially aligned with the second undersurface portions 94,94 of the side portions 32,32 of the anvil 28, while in effect a fourth depressed or recessed portion 98 is defined at an axially central portion of each jaw member 52,52. In a manner similar to portions 90,92,94, it is seen that the protrusions 96 and portion 98 comprise sections having substantially trapezoidal configurations which are complementary to portions 90,92,94. Accordingly, when the pivotal jaws 48,48 are moved to their full closed positions, the upwardly extending projections or protrusions 96, 96 will cooperate with the second undersurface portions 94, 94 of the side portions 32,32 of the anvil 28, the recessed portion 98,98 of each jaw member 52,52 will cooperate with the first undersurface portion 92 of the central section 30 of the anvil 28, and the undersurface portions 90,90 of the side plate recessed portions 82,82 will be disposed upon the sides of the jaw members 52,52 and at levels substantially coincident with the first surface portion 92 whereby as best seen in FIGS. 8 and 9, the resulting crimped seal member 74 and overlapped end portions 76,76 of the plastic strapping are formed with an undulated configuration across the axial extent thereof so as to form the resulting joint 100. This is significant because the overlapped end portions 76, 76 therefore cannot be simply pulled apart when axially oriented tensile forces are impressed upon the overlapped end portions 76,76 of the plastic strapping.

Thus, it may be seen that in accordance with the principles and teachings of the present invention, a new and improved manually-operable crimping tool for lockingly securing a seal member upon overlapped end portions of plastic strapping has been developed and disclosed. The tool is provided with the particularly aforenoted structure such that the resulting crimped seal member and overlapped end portions of the plastic strapping have an undulated configuration whereby the overlapped end portions of the plastic strapping cannot readily become loosened or disengaged with respect to each other under the influence of axially applied tensile forces. The present invention is also directed toward the particularly structured or configured seal member as well as toward the resulting sealed joint formed or defined between the seal member and the overlapped end portions of the plastic strapping.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A manually-operable tool for applying a seal member to overlapped end portions of plastic strapping material, comprising:

a pair of handles pivotally connected together about an axis defining an axial direction so as to be movable between relatively opened and relatively closed positions;

an anvil having a predetermined axial extent and a transverse extent;

a pair of jaws pivotally mounted upon opposite transverse end portions of said anvil between relatively opened and relatively closed positions and operatively connected to said pair of handles such that when said pair of handles are moved to their relatively opened positions, said pair of jaws are correspondingly moved to their relatively opened positions, and when said pair of handles are moved to their relatively closed positions, said pair of jaws are correspondingly moved to their relatively closed positions; and undulating structure formed upon each one of said anvil and said pair of jaws so as to extend in said axial direction and for cooperating together so as to form an undulated crimped joint upon overlapped end portions of plastic strapping when a seal member and overlapped end portions of plastic strapping are disposed between said anvil and said pair of jaws, and when said pair of jaws are moved to their relatively closed positions.

2. A tool as set forth in claim 1, wherein:

each one of said pair of jaws is pivotally mounted at a central portion thereof upon said anvil, a jaw member is formed at a first end portion of each one of said pair of jaws, and each one of said pair of jaws is pivotally connected at a second opposite end portion to a respective one of said pair of handles.

3. A tool as set forth in claim 2, further comprising:

a pair of side plates upon which said anvil is fixedly mounted, upon which said pair of handles are pivotally mounted, and upon which said pair of jaws are pivotally mounted.

4. A tool as set forth in claim 3, wherein:

each one of said pair of side plates comprises a channel portion;

opposite ends of a toggle pin are movably disposed within said channel portions of said pair of side plates;

first pivotal portions of said pair of handles being pivotally mounted upon said toggle pin; and second pivotal portions of said pair of handles being respectively pivotally connected to said second opposite end portions of said pair of jaws.

5. A tool as set forth in claim 2, wherein said structure formed upon said anvil and said pair of jaws, comprises:

a central section formed upon said anvil and defining a first surface portion, and a pair of recessed side sections formed upon said anvil defining second recessed surface portions such that said first and second surface portions are undulated with respect to each other in said axial direction; and each one of said jaw members of said pair of jaws comprises a recessed central portion and a pair of projecting side portions which are undulated with respect to each other for respectively cooperating with said first central and second recessed side surface portions of said anvil such that an undulated joint may be formed upon a seal member and overlapped end portions of plastic strapping.

6. A tool as set forth in claim 5, wherein:

each one of said side plates comprises a recessed surface portion for cooperating with said first and second surface portions of said anvil, and said recessed central portion and projecting side portions of said jaw members, so as to axially extend the axial extent of the undulated joint.

7. A tool as set forth in claim 1, wherein:

said undulating structure formed upon each one of said anvil and said pair of jaws comprises sections having substantially trapezoidal configurations.

8. A tool as set forth in claim 1, wherein:

each one of said jaws has an aperture defined therein for respectively housing an opposite transverse end portion of said anvil.

9. A manually-operable tool for applying a seal member to overlapped end portions of elongated material, comprising:

a pair of handles pivotally connected together about an axis defining an axial direction so as to be movable between relatively opened and relatively closed positions;

an anvil having a predetermined axial extent and a transverse extent;

a pair of jaws pivotally mounted upon opposite transverse end portions of said anvil between relatively opened and relatively closed positions and operatively connected to said pair of handles such that when said pair of handles are moved to their relatively opened positions, said pair of jaws are correspondingly moved to their relatively opened positions, and when said pair of handles are moved to their relatively closed positions, said pair of jaws are correspondingly moved to their relatively closed positions; and undulating structure formed upon each one of said anvil and said pair of jaws so as to extend in said axial direction and for cooperating together so as to form an undulated crimped joint upon overlapped end portions of elongated material when a seal member and overlapped end portions of the elongated material are disposed between said anvil and said pair of jaws, and when said pair of jaws are moved to their relatively closed positions.

10. A tool as set forth in claim 9, wherein:

each one of said pair of jaws is pivotally mounted at a central portion thereof upon said anvil, a jaw member is formed at a first end portion of each one of said pair of jaws, and each one of said pair of jaws is pivotally connected at a second opposite end portion to a respective one of said pair of handles.

11. A tool as set forth in claim 10, further comprising:

a pair of side plates upon which said anvil is fixedly mounted, upon which said pair of handles are pivotally mounted, and upon which said pair of jaws are pivotally mounted.

12. A tool as set forth in claim 11, wherein:

each one of said pair of side plates comprises a channel portion;

opposite ends of a toggle pin are movably disposed within said channel portions of said pair of side plates;

first pivotal portions of said pair of handles being pivotally mounted upon said toggle pin; and second pivotal portions of said pair of handles being respectively pivotally connected to said second opposite end portions of said pair of jaws.

13. A tool as set forth in claim 10, wherein said structure formed upon said anvil and said pair of jaws, comprises:

a central section formed upon said anvil and defining a first surface portion, and a pair of recessed side sections formed upon said anvil defining second recessed surface portions such that said first and second surface portions are undulated with respect to each other in said axial direction; and each one of said jaw members of said pair of jaws comprises a recessed central portion and a pair of projecting side portions which are undulated with respect to each other for respectively cooperating with said first central and second recessed side surface portions of said anvil such that an undulated joint may be formed upon the seal member and overlapped end portions of the elongated material.

14. A tool as set forth in claim 13, wherein:

each one of said side plates comprises a recessed surface portion for cooperating with said first and second surface portions of said anvil, and said recessed central portion and projecting side portions of said jaw members, so as to axially extend the axial extent of the undulated joint.

15. A tool as set forth in claim 9, wherein:

said undulating structure formed upon each one of said anvil and said pair of jaws comprises sections having substantially trapezoidal configurations.

16. A tool as set forth in claim 9, wherein:

each one of said jaws has an aperture defined therein for respectively housing an opposite transverse end portion of said anvil.

* * * * *